US005572296A

United States Patent [19]

Snelling et al.

[11] Patent Number: 5,572,296

[45] Date of Patent: Nov. 5, 1996

[54] COLOR PRINTING SYSTEM EMPLOYING NON-INTERACTIVE DEVELOPMENT

[75] Inventors: Christopher Snelling, Penfield; Richard F. Bergen, Ontario; Robert W. Gundlach, Victor; Dale R. Mashtare, Macedon, all of N.Y.

[73] Assignee: Xerox Corporation, Stamford, Conn.

[21] Appl. No.: 344,057

[22] Filed: Nov. 23, 1994

[51] Int. Cl.[6] ..... G03G 15/06

[52] U.S. Cl. ..... 399/265; 399/343

[58] Field of Search ..... 355/212, 245, 355/252, 273, 275, 296, 326 R, 327; 118/652, 653

[56] References Cited

U.S. PATENT DOCUMENTS

| | | | |
|---|---|---|---|
| 4,630,919 | 12/1986 | Fantuzzo et al. | 355/212 X |
| 4,806,991 | 2/1989 | Guslits | 355/212 |
| 5,012,290 | 4/1991 | Berkes et al. | 355/271 |
| 5,189,472 | 2/1993 | Haneda et al. | 355/212 |
| 5,311,267 | 5/1994 | Bean | 355/271 |

FOREIGN PATENT DOCUMENTS

| | | | |
|---|---|---|---|
| 63-38963 | 2/1988 | Japan | 355/212 |

*Primary Examiner*—William J. Royer
*Attorney, Agent, or Firm*—Lloyd F. Bean, II

[57] ABSTRACT

A multi-color printer using a stretch toner release development system to provide either partial or full color copies with minimal degradation of developed toner patterns by subsequent over-development with additional colors and minimal back contamination of developer materials. Multiple scanning beams, each modulated in accordance with distinct color image signals, are scanned across the printer's photoreceptor at relatively widely separated points, there being a buffer provided to control timing of the different color image signals to assure registration of the color images with one another. Each color image is developed prior to scanning of the photoreceptor by the next succeeding beam. After developing of the last color image, the composite color image is transferred to a copy sheet. Development is accomplished by stretching the surface of a toner carrying member and thereby reducing the net force of adhesion of toner to the surface of the toner carrying member.

13 Claims, 3 Drawing Sheets

COLOR PRINTING SYSTEM EMPLOYING NON-INTERACTIVE DEVELOPMENT

The invention relates to electronic copying/printing systems and more particularly to an electronic multi-color copying/printing system that employs non-interactive development.

In typical xerographic type color copiers, processing of the color copies is done in sequence. For example, in one well known commercial copier, a blue color separation image is first made, developed with yellow toner, and transferred to a copy sheet which is supported on a rotating drum synchronized to the copying process. Then, a second green color separation image is made, developed with magenta toner, and transferred to the copy sheet in superimposed registered relationship with the first color separation image. Lastly, a third red color separation image is made, developed with cyan toner, and transferred to the copy sheet in superimposed registered relationship with the previously transferred blue and green color separation images. The resulting combination of color separation images is thereafter fused to provide a permanent color copy.

As can be appreciated from the above discussion, the color copying process described is relatively slow, requiring approximately three times as much time to process one copy as is required to process a black and white copy. Additionally, great care must be taken to assure exact registration of the several color separation images with one another if a clear and exact copy of the color original is to be made.

Also, another problem with processing color copies is that present development techniques allow cross-color contamination of images or developer materials. A number of developing techniques are available for electrophotographic copying machines, and include a cascade technique, magnetic brush technique, powder cloud technique, jumping technique, and impression technique, to cite a few typical examples for dry type developing techniques. The developers used may comprise a one component system or a two component system.

To summarize the variety of developing techniques, the cascade technique and the magnetic brush technique which are used with a two component system provide a number of advantages including the stability of the developing process, and are actually in use in most copying machines which are commercially available. However, they have certain disadvantages. Considering the magnetic brush technique by way of example, the developer used with this technique comprises a toner and a carrier, and any change in the proportion of mixture thereof results in an adverse influence upon the optical density of the resulting image.

Considering the developing technique which is used with a single component developer, the powder cloud technique and the impression technique involve a disadvantage that during the developing process, the toner may be deposited not only on an image area, but also on a non-image area of an electrostatic latent image which is formed on a latent image carrying member, resulting in a so-called background fogging which represents a degradation in image quality. The fogging is caused by the absence of a removal force to detach any toner which may be held or attached to a non-image area by induced image charges or by physical influences other than electrostatic attraction.

A development apparatus having a toner carrying member and a piezoelectric vibrator for displacing toner from the toner carrying member and causing it to fly in a manner to avoid depositing toner onto a non-image area of an image bearing surface is disclosed in U.S. Pat. No. 4,546,722 in order to prevent degradation of the charged image for the purpose of image preservation. The apparatus avoids adverse influences upon the electrostatic latent image so as not to cause disturbance in the resulting image if applied in a multiple copy per exposure process to produce a plurality of copies. This apparatus is non-interactive from a latent electrostatic image preservation standpoint, but does not appear to be non-interactive from a developed toner image standpoint. This apparatus seems to be designed to prevent degradation of the charged image for the purpose of latent image preservation and not for the purpose of preventing degradation of the toned image pattern.

U.S. Pat. No. 4,833,503 discloses a multi-color printer using a sonic toner release development system to provide either partial or full color copies with minimal degradation of developed toner patterns by subsequent over-development with additional colors and minimal back contamination of developer materials. Development is accomplished by vibrating the surface of a toner carrying member and thereby reducing the net force of adhesion of toner to the surface of the toner carrying member. The sonic toner release development system has been found acceptable. However, the sonic toner release development system requires a need-for expensive acoustic transducers and associated drive electronics.

The above-mentioned features and others of the invention together with the manner of obtaining them will best be understood by making reference to the following specification in conjunction with the accompanying drawings, wherein.

Figure 5:
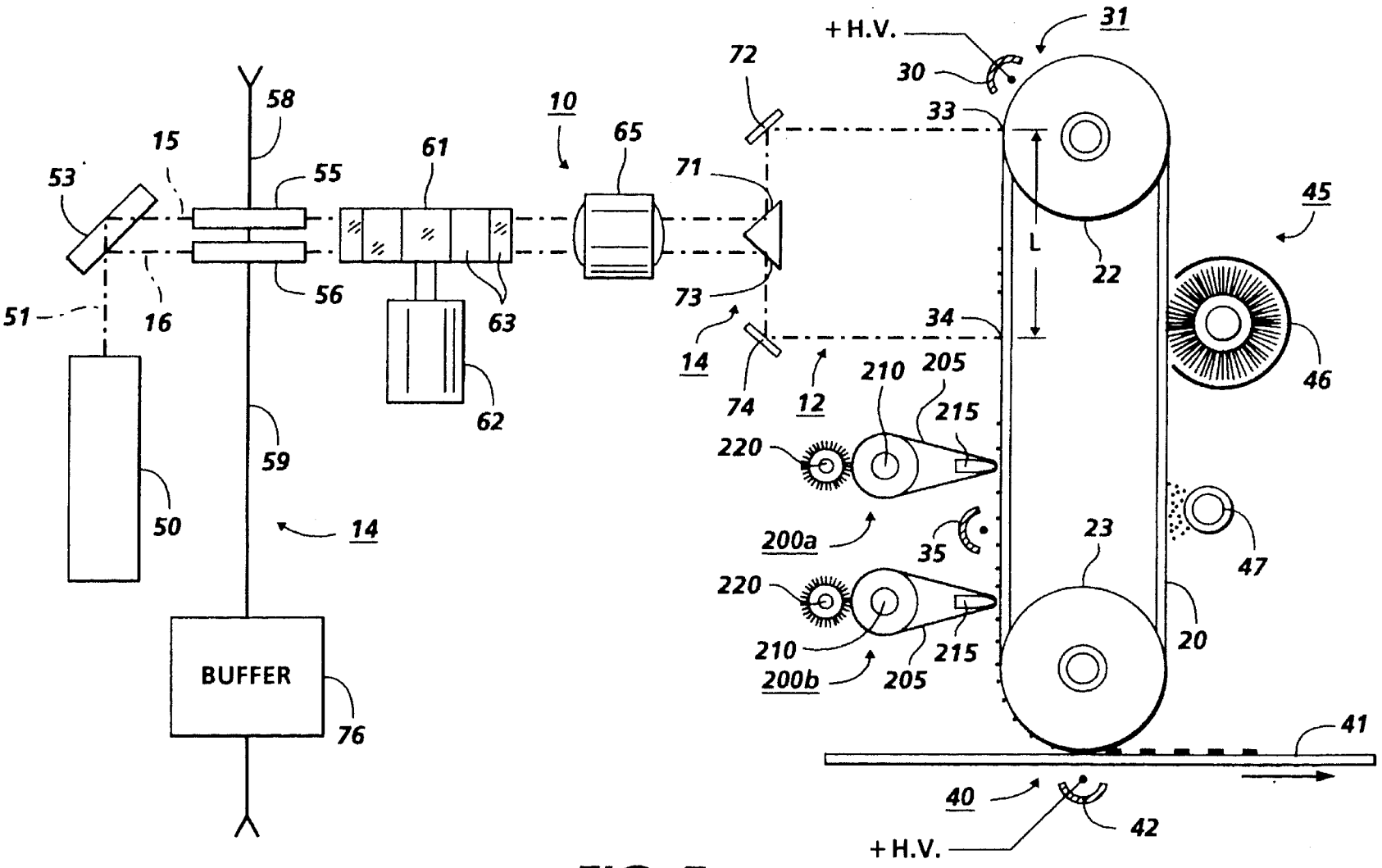
FIG. 5 is an enlarged schematic elevational view showing details of a multi-color printer employing the features of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims. For a general understanding of the features of the present invention, reference is had to the drawings. In the drawings, like reference numerals have been used throughout to designate identical elements. FIG. 5 schematically depicts the various components of an illustrative electrophotographic copying machine incorporating the stretch toner release development apparatus of the present invention therein.

Referring particularly to FIG. 5 of the drawings, there is shown the multi-color printer 10, as disclosed in U.S. Pat. No. 4,403,848 which is incorporated herein by reference, that employs the improved developer apparatus of the present invention. Printer 10 includes a xerographic processing section 12 and an image scanning or writing section 14, the latter serving to scan at least two high intensity imaging beams of electromagnetic radiation 15, 16 across photoreceptor 20 of xerographic section 12 to provide at least a dual color image as will appear herein.

Xerographic processing section 12 includes a photoreceptor 20 illustrated herein in the form of an endless belt stretched across drive and idler belt support rollers 22, 23 respectively. Belt supporting rollers 22, 23 are rotatably mounted in predetermined fixed position by suitable means (not shown). Roller 22 is driven from a suitable drive motor (not shown) to move photoreceptor 20 in the direction shown by the solid line arrow. While photoreceptor 20 is illustrated in the form of an endless belt, other photoreceptor configurations such as a drum may be envisioned.

Photoreceptor 20 comprises an inner layer or substrate composed of a suitable flexible electrically conductive substrate with an outer photoconductive layer such as selenium thereupon. Photoreceptor 20 may be opaque, that is, impervious to electromagnetic radiation such as light, or wholly or partially transparent. The exemplary photoreceptor 20 typically has an aluminum substrate which renders the photoreceptor opaque. However, other substrate materials such as glass may be contemplated which would render photoreceptor 20 wholly or partially transparent, and photoreceptor materials other than selenium as for example organic resins may also be contemplated. One organic type material for example consists of an aluminized mylar substrate having a layer of selenium dispersed in poly-N-vinyl carbazole with a transparent polymer overcoating containing a charge transport compound such as pyrene.

Referring again particularly to FIG. 5, a corona charging device 30 commonly known as a corotron is operatively disposed adjacent photoreceptor 20 at charging station 31. Corotron 30 which is coupled to a suitable negative high voltage source (–Hv) serves to place a uniform negative charge on photoreceptor 20 in preparation for imaging.

Imaging beams 15, 16 impinge or contact photoreceptor 20 at exposure points 33, 34 respectively, the exposure point 34 of beam 16 being spaced a predetermined distance (L) downstream from that of the contact point 33 of imaging beam 15. Developers 200 each include a suitable developer housing (not shown) within which a supply of color developing material is provided together with means for loading the color developing material onto the developer's magnetic brush roll.

As will be understood by those skilled in the xerographic arts, the color developing material normally consists of a suitable carrier material with hereinafter, toner is drawn to the latent electrostatic images formed on photoreceptor 20 by imaging beams 15, 16 in proportion to the image charge levels to develop the images. In the present arrangement, a discharge development system is used wherein, following negative charging of photoreceptor 20 by corotron 30, image areas are discharged by beams 15, 16 in accordance with image signals. The developing toner is negatively charged and is therefore attracted to the discharged image areas while being repelled from the undischarged non-image areas.

It will be understood that the developing materials and particularly the toner is selected to provide the color image desired. For example, in the two developer arrangement disclosed in FIG. 5, the first developer apparatus **200*a* in the process direction utilizes a red toner, while the second developer apparatus 200*b* utilizes a black toner. In that example, the developed image would be composed of red and black image areas in accordance with the particular colored image patterns generated by imaging beams 15, 16. Other color combinations may of course be envisioned. One type of toner found particularly suitable for use herein consists of toner materials that are transparent to electromagnetic radiation. As will appear, this type of toner permits subsequent imaging to be effected through previously developed toner images as when forming a second or third color separation image. Also, it is possible to enhance the process by introducing an additional charging unit 35** prior to subsequent exposure(s) to enhance uniformity of the photoreceptor potential, i.e., neutralize the potential of the previous image.

To eliminate or reduce contamination or cross-mixing of toner, developer apparatus 200 includes means for agitating toner in close proximity to a development nip formed between developer apparatus 200 and photoreceptor 20 which makes for non-interactive development of different toners which will be discussed in more detail hereinafter.

Following development of the electrostatic image created on photoreceptor 20 by colored developers, the developed image is transferred to a suitable copy substrate material 41 such as paper at transfer station 40. To facilitate transfer, a transfer corotron 42 which is coupled to a high voltage power source (+HV) is provided to attract the developed image on photoreceptor 20 to copy substrate material 41. Following transfer, the developed image is fixed as by a fuser (not shown). Residual toner on photoreceptor 20 is removed at cleaning station 45 by erase lamp 47 and cleaning brush 46 respectively.

Image scanning section 14 includes a suitable source of high intensity electromagnetic radiation exemplified herein by laser 50. The beam of light 51 generated by laser 50 is separated into imaging beams 15, 16 by suitable means such as mirror 53. The pair of beams reflected from mirror 53 pass through individual beam modulators 55, 56 which serve to modulate the intensity of the imaging beams 15, 16 in response to image signals input thereto through signal lines 58, 59. Modulators 55, 56 may comprise any suitable type of modulator such as an acousto optic type modulator. The image signals in lines 58, 59 may be derived from any suitable source such as an image input scanner, memory, communication channel, and the like.

From modulators 55, 56 the imaging beams 15, 16 strike a suitable scanning element shown here as rotating polygon 61. Polygon 61 is rotated by motor 62 in synchronism with movement of photoreceptor 20 and at a speed sufficient to scan imaging beams 15, 16 across photoreceptor 20 without noticeable distortion. A suitable lens 65 serves to focus the imaging beams 15, 16 reflected from the mirrored facets 63 of polygon 61 onto photoreceptor 20. As described heretofore, imaging beams 15, 16 impinge on photoreceptor 20 at exposure points 33, 34 respectively which are spaced a predetermined distance L from one another along photoreceptor 20, the distance L being chosen to accommodate the color developer. To provide the requisite spacing L between exposure points 33, 34, mirror pairs 71, 72 and 73, 74 are provided to re-route imaging beams 15, 16 mirrors 71, 73 serving to first turn beams 15, 16 in an outward direction substantially paralleling the path of movement of photoreceptor 20 with mirrors 72,74 serving to restore beams 15, 16 to a direction which will intersect photoreceptor 20 at exposure points 33, 34 respectively. Mirrors 72, 74 as will be understood, are spaced apart by the distance L in the exemplary arrangement shown.

To accommodate the exposure delay due to spacing of the second imaging beam downstream of the first imaging beam to allow development of one color image before exposure to create the latent image for the next color and to assure registration of the second color image with the first color image, a suitable image signal delay device such as buffer 76 is provided in the image signal input line 59 to modulator 56. Buffer 76 is chosen to delay input of the image signals to modulator 56 by an interval sufficient to register the second color image with the first color image.

While imaging beams 15, 16 are illustrated as impinging on the exterior of photoreceptor 20, it will be understood that in the case where photoreceptor is transparent or partially transparent, imaging beam 16 and if desired imaging beam 15 may be disposed to impinge against the interior of photoreceptor 20.

Figure 1:
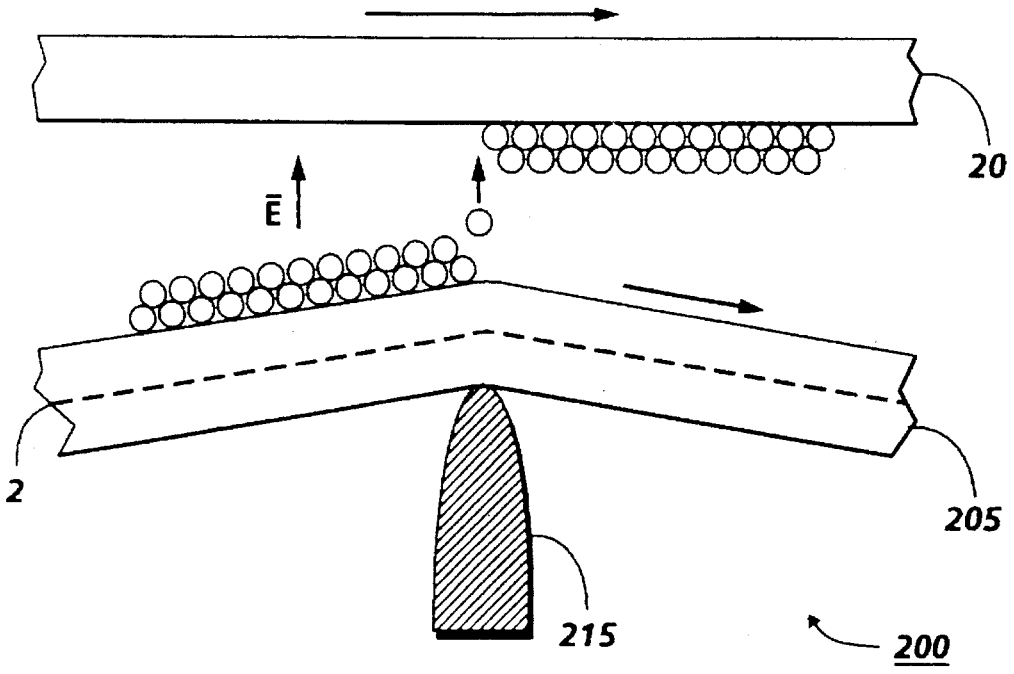
FIG. 1 is an enlarged view showing details of the process employed to loosen toner particles.

Turning now to FIG. 1 and the present invention, an enlarged development apparatus 200 is shown that accomplishes stretch toner release in a non-interactive development process having minimal interactive effects between deposited (developed) toner and subsequently presented toner. The development apparatus 200 is a means to achieve multicolor single transfer systems without cross-color contamination of images and/or developer materials (scavenging effects). The development apparatus 200 is typical of developing apparatuses of the present invention and comprises a flexible belt 205 as a donor member having a portion thereof closely spaced with respect to photoreceptor 20 in what is commonly known as touchdown development. The belt 205 is entrained around spaced roller 210 and stretch member 215. Roller 210 is the driver and is positioned adjacent a magnetic brush toner loading device 220 as shown in FIG. 5. Belt 205 has a grounded D.C. bias applied to its outside surface. The outside surface of the belt includes a conductive coating thereon. Additionally, a relaxable overcoat layer may be applied over this conductive layer. Stretch member or protruding element 215 stretches belt 205 so that there is a sufficient reduction of the net force of adhesion of toner to the donor surface to enable electrostatic forces to selectively remove toner from the donor and transport it to desired areas of development on the receptor.

The selective toner removal characteristics of stretch toner release development distinguish it from powder cloud (and jumping) development where airborne toner is presented to the entire receptor regardless of it's potential. This distinction provides an important copy quality advantage with stretch toner release since wrong sign and non-charged toner deposition is inhibited. In addition, interaction effects between successive developments with different toners (colors) are minimal. Development system advantages obtained with single transfer and enabled by non-interactive development include simplified (on the receptor) registration of images, increased thruput, and reduced system complexity.

Stretch toner release enables toner release under lower electrostatic fields and thereby to reduce image noise in toner gap jumping processes by reducing the probability of air breakdown and encouraging toners to act independently rather than in clumps or agglomerates. The basic premise of the "Stretch" process is that adhesion of toner particles to a surface depends upon intimate contact, or points of contact, with the surface. Localized stretching or bending of the surface can sufficiently reduce the net force of adhesion of toners to the surface to facilitate their removal by an external force. The "Stretch" process depends upon changes in donor surface morphology to reduce adhesion of toner particles to the surface. Donor surface strain, which is believed to-cause the stretch effect, depends upon both the bend radius and the distance of the surface from the neutral ("0 strain") plane 2. Alternatively, elongation of the entire donor member in the nip can serve to alter the effective donor surface area providing similar surface strain effects on toner adhesion to the donor surface. In FIG. 1, the neutral plane 2 is shown in the center of the donor which implies a uniform modulus through a simple donor. Complex donor structures such as the photoreceptor belts that have been used in "Stretch" process studies may have neutral planes displaced from the center and therefore can provide increased surface strains relative to those achieved with simple uniform modulus donors. Optimization of donor design for "Stretch" process applications will include tailoring of donor material(s) moduli to maximize the distance of the toner loaded surface from the neutral axis of the donor. The photoreceptor donor is a multiple material layer approach. Another approach could use photopolymerization to favorably alter the modulus through a homogeneous photopolymer layer to enhance surface strain.

FIG. 1 shows a toner loaded donor surface separated from a receiver surface with an air gap to achieve the desired non-interactive development function. An air gap has been included in the figure for illustrative purposes only. Application of electric field E between the receiver and donor surfaces exerts a force F=QE on the toner particles. The positive polarity toner charge that has been assumed for this example directs the force F toward the receiver. When the magnitude of force F is greater than the "reduced" adhesion, toner particles are detached from the donor and transfer to the receiver surface. Two mechanisms which are believed to reduce adhesion are: 1) Shear at toner particle points of contact with the deformed donor surface: In FIG. 1, for example, a homogeneous donor is shown bent over a protruding element. In the absence of net tension, strain induced in the donor material will vary linearly from elongation at the top surface to compression at the lower surface. In this case, a neutral plane (no strain) will occur at the geometric center of the donor film. The hypothesis is that even intermittent reductions in adhesion due to the resulting shear between toner and donor surfaces can allow the QE force to remove toners from the donor surface. 2) Toner particle redistribution on the deformed donor surface: With greater than monolayer loadings of toner, elongation of the donor surface in FIG. 1 due to bending over the protruding element will cause some redistribution of toner particles. Toner mass per area loading must decrease as the donor area is increased at the bend and return again to its original value where the donor straightens, unless toners are removed by the simultaneously applied QE force. This mechanism addresses the release of toners not in direct contact with the donor film surface.

Figure 2:
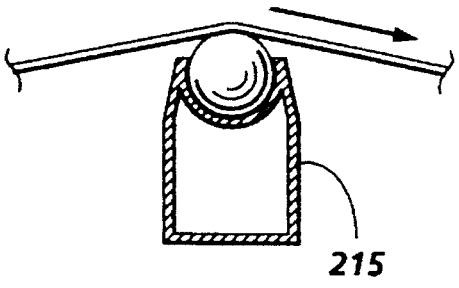
FIGS. 2 and 3 are alternative embodiments of a protruding element which can be employed with the present invention.
Figure 3:
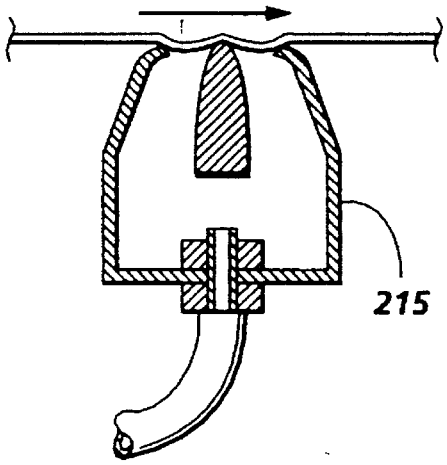

Deformation of donor surfaces can be accomplished by several techniques. A particularly effective design is illustrated in FIG. 2. It includes a line of captured small ball bearings over which a donor was tensioned. Effectiveness of the ball design may be related to two dimensional stretching of the donor in regions tangent to the balls. A design that has been shown to enhance toner transfer on a machine is shown in FIG. 3. One advantageous feature of this embodiment is that vacuum hold-down eliminates the need for web tension in this approach. In another vacuum hold-down design (not shown), a piece of woven screen was used to cover the protruding elements which created a pattern on the protruding elements over which the donor web was drawn. Vacuum hold-down designs enable complex distortions of the donor including both convex and concave bends.

It will no doubt be appreciated that the inventive stretch process has equal application in the photoreceptor cleaning station and toner transfer station of an electrophotographic device with little variation in structure.

Figure 4:
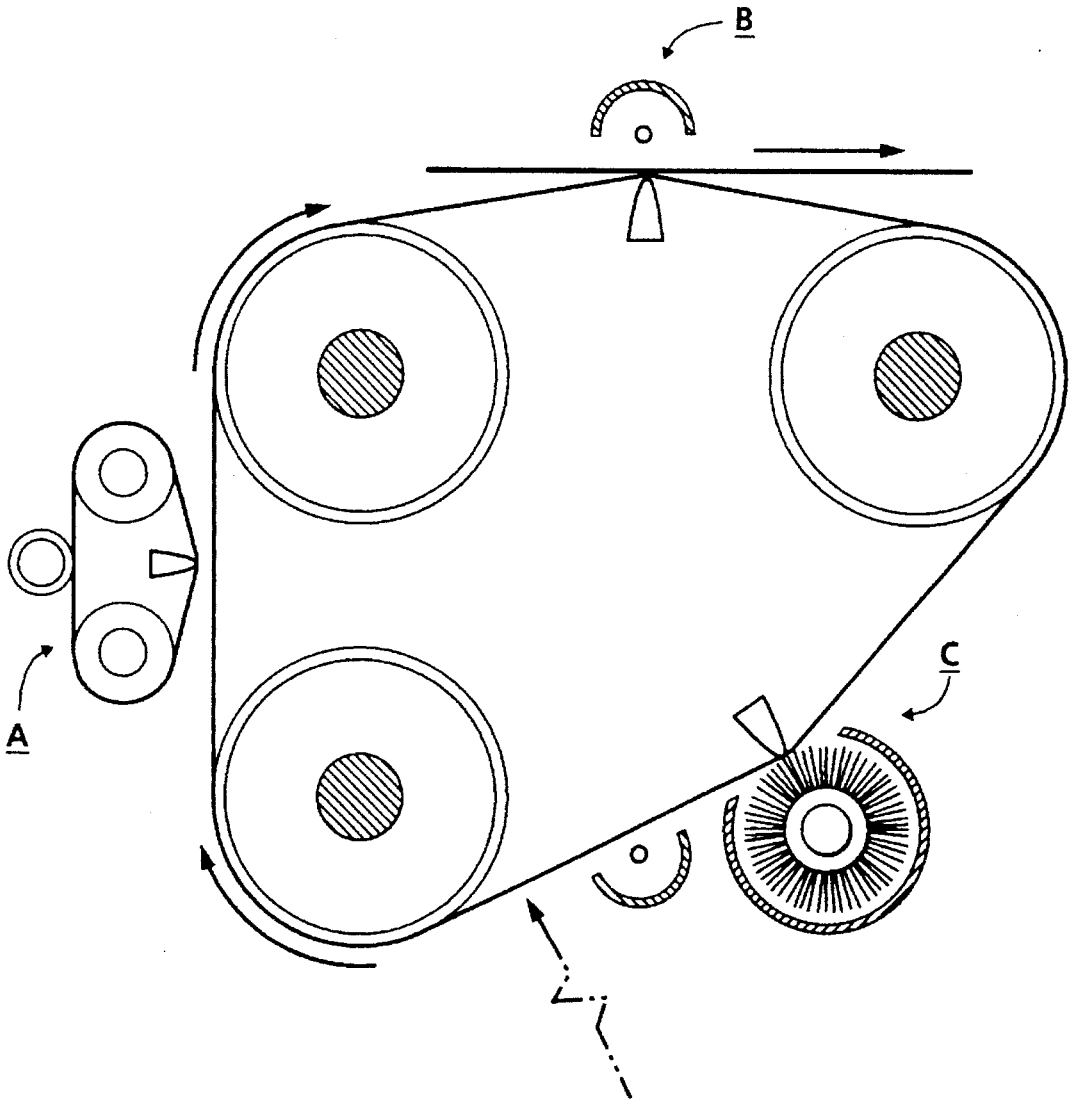
FIG. 4 is a schematic elevational view showing the present invention employed in a development station, cleaning station and transfer station.

Application of the "Stretch" process for toner release to development, transfer and cleaning process steps is illustrated in the "Stretch" System represented in FIG. 4. The "Stretch" development subsystem shown includes means (i.e. magnetic brush) to load a donor belt with toner. The donor is deformed (stretched) in the development zone A by a stretch member to facilitate toner release. In the transfer zone B the photoreceptor is deformed to enhance transfer. Finally, in the cleaning zone C, deformation of the photoreceptor is included to facilitate removal of residual toner by the cleaning brush.

In summary, the "Stretch" process is proposed as a means to facilitate and improve the uniformity and efficiency of toner release from donor surfaces in several xerographic process steps. The advantages of stretch toner release include enhanced copy quality by virtue of reducing developed/transferred toner image noise with minimal added apparatus and expense.

It should now be apparent that a process and apparatus has been disclosed that includes loosening charged toner from a donor member by stretching of the donor member. Loosening of the toner reduces the net forces holding the particles to the donor member. Toner stays on the surface of the donor member unless there is an image field adjacent to the donor member to extract it, thereby making the apparatus and process non-scavenging and non-interactive.

While the embodiments of this invention have been described with reference to a printer that includes a laser generated image source, it should be understood that the invention works equally as well with a light lens system as employed in conventional copiers and duplicators.

What is claimed is:

1. A printing machine, comprising;

a flexible member having particles thereon; and a deflector, operatively associated with said flexible member, to stretch said flexible member loosening particles adhering thereto; and a member having a latent image recorded thereon, said member being adjacent said flexible member to receive particles therefrom developing the latent image recorded thereon.

2. A printing machine according to claim 1, wherein said flexible member comprises a member having a latent image recorded thereon with the particles being in image configuration thereon.

3. A printing machine according to claim 2, further comprising:

a corona generator disposed adjacent said member; and a sheet adapted to move between said corona generator and said member, said corona generator charging said sheet to attract particles from said member to said sheet forming a powder image thereon.

4. A printing machine according to claim 2, further comprising a cleaning system, operatively associated with said member, to remove particles therefrom.

5. A printing machine, according to claim 1, wherein said deflector comprises:

a protruding member adapted to contact said flexible member; and means for driving said protruding member to stretch said flexible member to loosen particles thereon.

6. A printing machine according to claim 1, wherein said deflector comprises:

a protruding member adapted to contact said flexible member; and means, adjacent to said protruding member for attracting said flexible member into engagement with said protruding member to stretch said flexible member loosening particles thereon.

7. A printing machine according to claim 1, wherein said flexible member comprises a polymer belt with a conductive coating thereon supportively positioned adjacent said member.

8. A printing machine according to claim 7, further comprising a particle bearing member, in communication with said belt, to apply particles on said belt.

9. A developer unit, comprising:

a flexible member having particles thereon; and a deflector, operatively associated with said flexible member, to stretch said flexible member loosening particles adhering thereto.

10. A developer unit according to claim 9, wherein said deflector comprises:

a protruding member adapted to contact said flexible member; and means for driving said protruding member to stretch said flexible member to loosen particles thereon.

11. A developer unit according to claim 9, wherein said flexible member comprises:

a protruding member adapted to contact said flexible member; and means, adjacent to said protruding member for attracting said flexible member into engagement with said protruding member to stretch said flexible member loosening particles thereon.

12. A developer unit according to claim 9, wherein said flexible member comprises a piezoelectric polymer belt with a conductive coating thereon supportively positioned adjacent said flexible member.

13. A developer unit according to claim 12, further comprising a particle bearing member, in communication with said belt, to apply particles on said belt.

* * * * *